US006956161B2

(12) United States Patent
Kondo

(10) Patent No.: US 6,956,161 B2
(45) Date of Patent: Oct. 18, 2005

(54) MUSICAL PERFORMANCE DATA SEARCH SYSTEM

(75) Inventor: Masao Kondo, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 188 days.

(21) Appl. No.: 10/090,303

(22) Filed: Mar. 4, 2002

(65) Prior Publication Data

US 2002/0124714 A1 Sep. 12, 2002

(30) Foreign Application Priority Data

Mar. 2, 2001 (JP) ..... 2001-058333

(51) Int. Cl.[7] ..... A63H 5/00; G04B 13/00; G10H 7/00

(52) U.S. Cl. ..... 84/609

(58) Field of Search ..... 84/600–602, 609, 84/634

(56) References Cited

U.S. PATENT DOCUMENTS 5,616,876 A * 4/1997 Cluts ..... 84/609
5,739,451 A * 4/1998 Winksy et al. ..... 84/609
5,918,303 A * 6/1999 Yamaura et al. ..... 84/609
6,232,539 B1 * 5/2001 Looney et al. ..... 84/609
6,248,946 B1 * 6/2001 Dwek ..... 84/609
6,307,139 B1 * 10/2001 Iwamura ..... 84/601
6,545,209 B1 * 4/2003 Flannery et al. ..... 84/609

FOREIGN PATENT DOCUMENTS

| | | | |
|---|---|---|---|
| JP | 5-273975 | A | 10/1993 |
| JP | 10-207460 | A | 8/1998 |
| JP | 10-207460 | | 8/1998 |
| JP | 10-274981 | A | 10/1998 |
| JP | 2001-52004 | A | 2/2001 |

* cited by examiner

*Primary Examiner*—Jeffrey W. Donels
(74) *Attorney, Agent, or Firm*—Rossi, Kimms & McDowe

(57) ABSTRACT

A musical performance data search system has: a first storage unit for storing a plurality of first data sets including performance data for automatic accompaniment; a second storage unit for storing a second data set related to one of the first data sets, the second data set including information for searching the first data set; a designating unit for designating the second data set; an editing unit for editing the second data set designated by the designating unit; and a unit for reading the first data set related to the second data set designated by the designating unit. With the musical performance data search system unit, a user can edit related information for searching a style.

5 Claims, 10 Drawing Sheets

MUSICAL PERFORMANCE DATA SEARCH SYSTEM

BACKGROUND OF THE INVENTION

A) Field of the Invention

The present invention relates to a musical performance data search system, and more particularly to a musical performance data search system having a related information editing function.

B) Description of the Related Art

A user of an automatic musical performance apparatus plays only a melody line, and makes the apparatus reproduce style data (hereinafter simply called a "style") which is accompaniment data stored in the apparatus, by searching and designating the style by using the apparatus.

Accompaniment which matches a melody line is generally selected by a user. In this case, the user selects the style in accordance with related information such as genres of music programs listed on a display device.

A style can also be selected by designating the title of a music program matching the image of music to be played, as disclosed in the embodiment of JP-A-10-207460.

In a conventional musical performance data search system, only preset data is used as related information (which can image the style such as genre, music title and tempo) for searching the style, and related information or preset data cannot be edited.

SUMMARY OF THE INVENTION

It is an object of present invention to provide a musical performance data search system capable of editing related information to be used for searching a style.

According to one aspect of the present invention, there is provided a musical performance data search system comprising: first storage unit for storing a plurality of first data sets including performance data for automatic accompaniment; second storage unit for storing a second data set related to one of the first data sets, the second data set including information for searching the first data set; designating unit for designating the second data set; editing unit for editing the second data set designated by the designating unit; and unit for reading the first data set related to the second data set designated by the designating unit.

As above, a musical performance data search system is provided which can edit related information to be used for searching a style.

DESCRIPTION OF THE PREFERRED EMBODIMENTS

Figure 1:
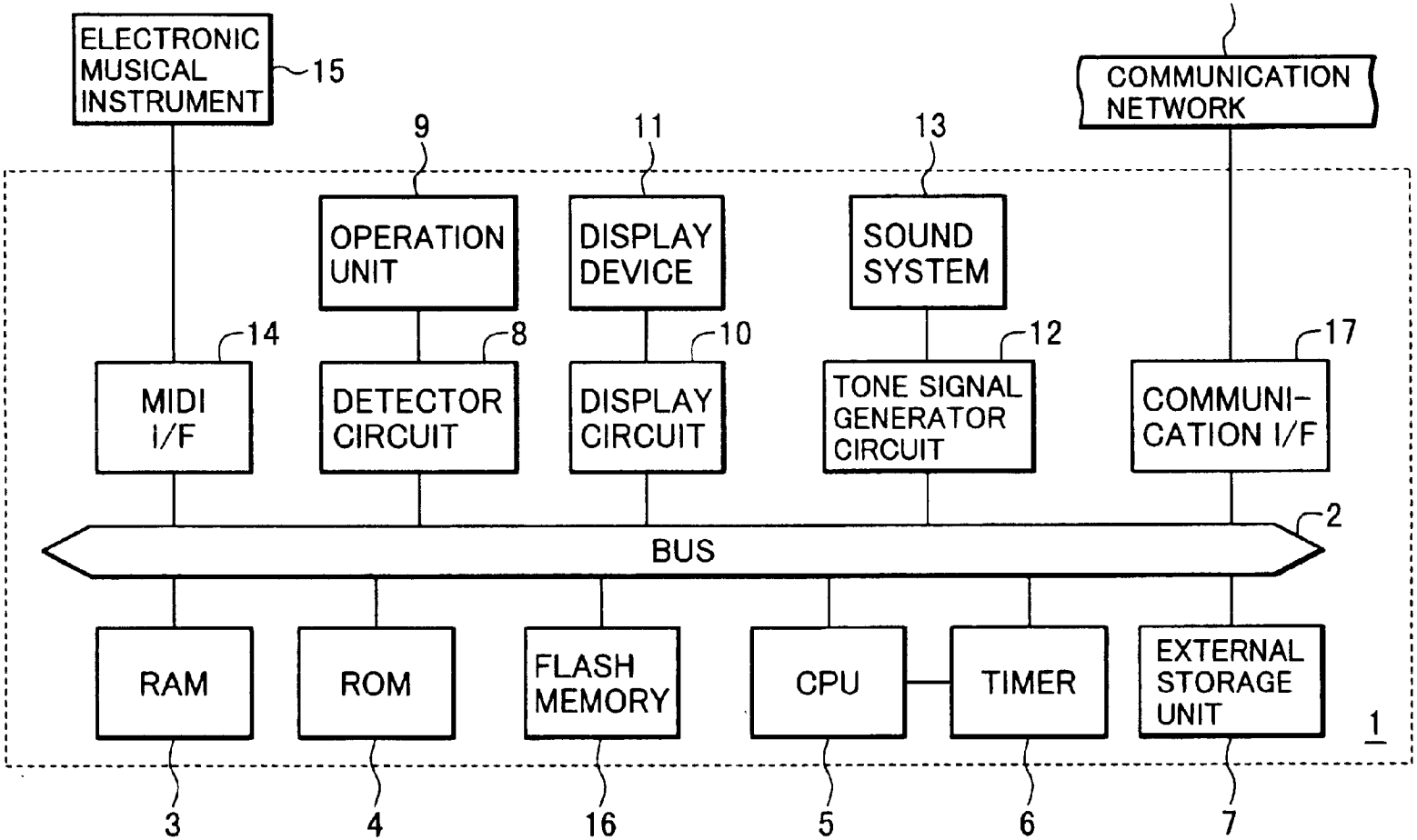
FIG. 1 is a block diagram showing the hardware structure of an electronic musical instrument equipped with a musical performance data search system according to an embodiment of the invention.

FIG. 1 is a block diagram showing the hardware structure of an electronic musical instrument equipped with a musical performance data search system according to an embodiment of the invention.

The electronic musical instrument has a bus 2, a RAM 3, a ROM 4, a CPU 5, a timer 6, an external storage unit 7, a detector circuit 8, an operation unit 9, a display circuit 10, a display device 11, a tone signal generator circuit 12, a sound system 13, a MIDI interface (I/F) 14, a flash memory 16, and a communication interface (I/F) 17.

The RAM 3, ROM 4, CPU 5, timer 6, external storage unit 7, detector circuit 8, display circuit 10, tone signal generator circuit 12, MIDI interface (I/F) 14, flash memory 16 and communication interface (I/F) 17 are interconnected by the bus 2.

A user can enter various information, various instructions such as selection of a style, and various settings, by using the operation unit 9 connected to the detector circuit 8. The operation unit 9 may be of any type so long as it can output a signal corresponding to a user input, such as mouse, switch, alphanumeric keyboard, musical performance keyboard, touch pad, joggle shuttle and joy stick.

The display circuit 10 is connected to the display device 11 which displays a staff notation, a list of styles, a list of various functions and other data. By referring to the information displayed on the display device 11, a user can select, enter and set various information.

In this embodiment, the display device 11 is provided with software switches as part of the operation unit 9. By operating the software switch, a user can select, enter and set various information.

The external storage unit 7 has an interface via which it is connected to the bus 2. The external storage unit 7 may be a semiconductor memory card such as a flash memory card, a floppy disc drive (FDD), a hard disc drive (HDD), a magneto optical (MO) disc drive, a compact disc read-only memory (CD-ROM) drive and a digital versatile disc (DVD) drive.

In this embodiment, a FDD is used as the external storage unit 7. Import and export of style data and the like to be described later and update of preset records and the like can be performed through involvement of FDD.

If HDD or the like is connected as the external storage unit 7 to the electronic musical instrument 1, various parameters, data and programs for realizing the embodiment functions can be stored in HDD.

RAM 3 has working areas of CPU 5 storing various parameters, such as flags, registers and buffers. In this embodiment, styles and records to be described later are temporarily stored in RAM 3.

ROM 4 stores various parameters and control programs, and programs for realizing the embodiment functions. These data and programs are not necessary to be stored in duplicate in the external storage unit 7.

CPU 5 performs calculations and controls for various processes to be described later, in accordance with the control programs stored in ROM 4 or in the external storage unit 7.

The timer 6 connected to CPU 5 and bus 2 supplies CPU 5 with base clock signals, interrupt timings and the like.

The tone generator circuit 12 generates tone signals corresponding to supplied MIDI signals or the like and supplies the tone signals to the sound system 13. The sound system 13 includes a D/A converter and speakers, and converts supplied digital tone signals into analog tone signals to produce sounds.

The tone signal generator circuit 12 may be of any type such as a waveform memory type, an FM type, a physical model type, a harmonics synthesizer type, a formant synthesizer type, and an analog synthesizer type of voltage controlled oscillator (VCO)+voltage controlled filter (VCF)+voltage controlled amplifier (VCA).

The tone signal generator circuit 12 is not limited only to dedicated hardware, but it may be configured by a digital signal processor (DSP) and microprograms, by a CPU and software programs, or by a sound card.

A single tone signal generator circuit may be used time divisionally to form a plurality of sound channels, or a plurality of tone signal generator circuits may by used to form a plurality of sound channels one channel per each tone signal generator circuit.

MIDI I/F 14 is connected to an electronic musical instrument 15. MIDI I/F 14 is connectable to a musical instrument, an electronic musical instrument, an acoustic machine, a computer or the like. MIDI I/F 14 can input and output performance signals or music data of at least the MIDI format. MIDI I/F 14 is not limited only to dedicated MIDI interface, but it may be general interface such as RS-232C, universal serial bus (USB) and IEEE1394 (I triple E 1394). Data other than MIDI messages may be transmitted or received at the same time when MIDI messages are transferred.

The electronic musical instrument 15 is an acoustic machine, a musical instrument or the like connected to MIDI I/F 14. The electronic musical instrument may be of any type such as a stringed type, a wind type and a percussion type. A user plays music by using the electronic musical instrument 15.

The electronic musical instrument may be of an integrated type having a tone signal generator, an automatic performance apparatus and the like built in the instrument, or of a discrete type with components connected by communication means such as MIDI network and other networks. The electronic musical instrument 15 may be used as the operation unit 9 for entering various settings and information.

Control programs and programs for realizing the embodiment functions may be stored in the external storage unit 7. If the control programs or the like are read from the external storage unit 7 into RAM3, CPU 5 can perform operations in a manner similar to the case that the control programs or the like are stored in ROM 4. In this case, addition, version-up and the like of the control programs or the like can be made easy.

Control programs and programs for realizing the embodiment functions may be stored in CD-ROM. In this case, if CD-ROM and HDD are provided as the external storage unit 7, the control programs and programs for realizing the embodiment functions can be copied from CD-ROM to HDD. New installation and version-up of the control programs and the like can be made easy.

The communication interface 17 is connectable to the communication network 18 such as a local area network (LAN), the Internet and telephone line. Various data constituting a database of the embodiment such as style data to be described later, control programs and programs for realizing the embodiment functions can be downloaded from a server connected to the network 18 into the flash memory 16, external storage unit 7 such as HDD, or RAM 3.

The communication interface 17 and communication network 18 may be of either a wired type or a wireless type, or may have both types.

The flash memory 16 is a rewritable memory such as a semiconductor memory, and stores the database of the embodiment.

Figure 2:
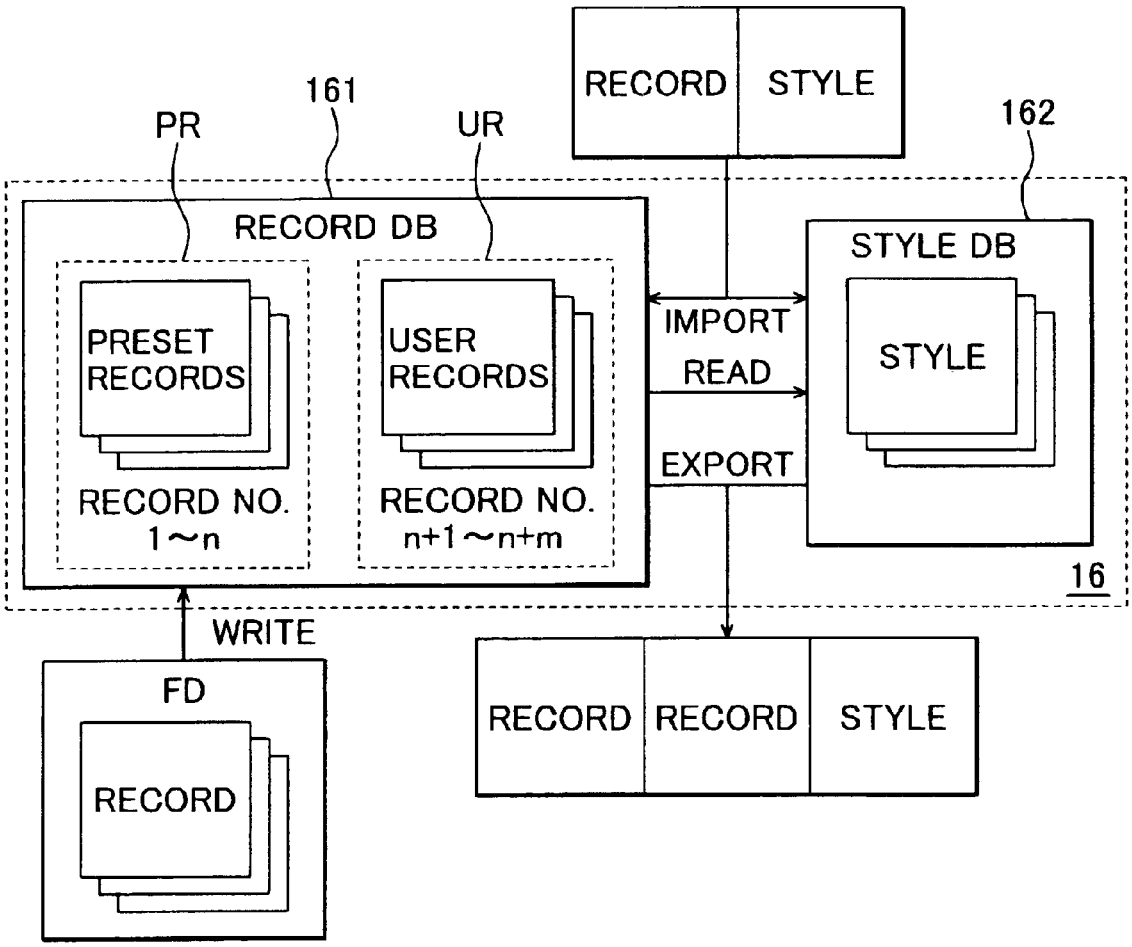
FIG. 2 is a block diagram showing the contents of a database.

FIG. 2 shows the configuration of the database in the flash memory 16.

The database in the flash memory 16 includes a record database (DB) 161 and a style database (DB) 162.

The record DB 161 stores a plurality of preset records and can store records formed by users. The record DB 161 includes a preset record area PR for storing preset records and a user record area UR for storing user records.

In this embodiment, the record is information (related information) allowing a user to image music. Each record is related to a style optimum to music to be imaged. When a style is to be searched, a list of all records is displayed on the display device 11. A user designates the style by selecting the record matching the image of music to be played from the list.

Each record of the record DB 161 is assigned a record number as a search index. In this embodiment, record numbers 1 to n are assigned to the preset records, and record numbers n+1 to n+m are assigned to the user records.

Figure 3A:
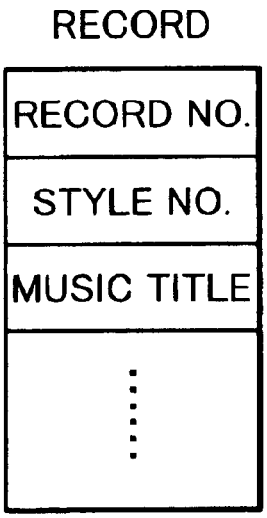
FIGS. 3A and 3B are diagrams showing the contents of a record and a style.

As shown in FIG. 3A, each record has a record number, a style number and a music title. The style number field stores the number of one style matching the image of the record. The music title field stores the titles of music having the same image as that of the style designated by the record.

In addition, each record stores a musical genre name of the music imaged by the record and the style designated by the record, the rhythm and tempo of the music, the keyword associating the music, and the like.

The contents of all the preset records and user records in the record DB 161 can be altered or the records themselves can be deleted. New user records can be created and stored in the user record area UR.

Figure 3B:
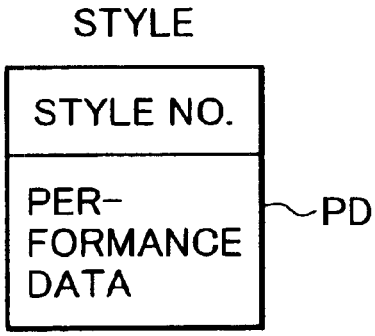

The style DB 162 stores a plurality of styles. As shown in FIG. 3B, each style includes a style number and automatic accompaniment data of a plurality of sections.

The style number is used for identifying each style and assigned a number unique to the style. Each style has a style name as well and the style number.

The performance data PD contains data necessary for automatic accompaniment. This automatic accompaniment data is used for reproducing accompaniment having a length of one to several measures (a performance length shorter than one music piece) and used, for example, for introduction sections, fill-in sections, main sections and ending sections. The performance data PD may contain tempo data, tone color data and the like.

The format of performance data may be of any type such as an "event+relative time" type in which an occurrence time of a performance event is represented by a time starting from one previous event, an "event+absolute time" in which an occurrence time of a performance event is represented by an absolute time in music or measure, a "pitch (rest)+code length" type in which performance data is represented by a code pitch and code length and by a rest and rest length, and a "direct" type in which a memory area corresponding to each minimum resolution of performance is reserved and a performance event is stored in the memory area corresponding to the time when the performance event occurs.

As a method of processing performance data, conventionally known techniques are utilized. Namely, in accordance with the process timing corresponding to the preset tempo, each event of performance data is sequentially sent to the tone signal generator circuit 12 at the corresponding process timing to reproduce music.

As a method of storing automatic accompaniment data of a plurality of channels, data of a plurality of channels may be stored in a mixed state or data of each channel may be stored for each track.

Time sequential performance data may be stored in continuous areas of a memory, or data stored in skipped areas may be processed as continuous data. It is not necessary that data is stored in continuous areas of the memory if the data can be processed as time sequentially continuous data.

As a user selects a record containing a music title or the like matching the user image from the list of records displayed on the display device 11 by using the operation unit 9, the style having the style number in the selected record is searched from the style DB 162 and read into RAM 3.

The style read into RAM 3 is the selected style. During the automatic accompaniment (automatic performance), the performance data of the style read into RAM 3 is reproduced.

The style can be imported or exported as style information.

When a style is to be exported, the designated style is read from the style DB 162, and all records related to the designated style are searched and read from the record DB 161. The read style and records can be supplied to the external as the style information. Each record in the style information has no record number.

The style information is stored, for example, in the external storage unit 7. If the style information is stored in a removable medium such as a floppy disc and MO, the style information can be imported to another electronic musical instrument. The style information may be stored in HDD as back-up copies. The export process will be later detailed with reference to FIG. 12.

When the style information containing a corresponding record is imported, the style and record are separately stored in the style DB 162 and record DB 161. The import process will be later detailed with reference to FIG. 11.

Export and import of the style information can be performed via the communication I/F 17 instead of the external storage unit 7.

The record DB 161 may be upgraded (overwritten) by a new record group by using a floppy disc or the like. Each record of the new record group stored in the floppy disc or the like is assigned a record number. The overwrite process will be later detailed with reference to FIG. 13.

Figure 4:
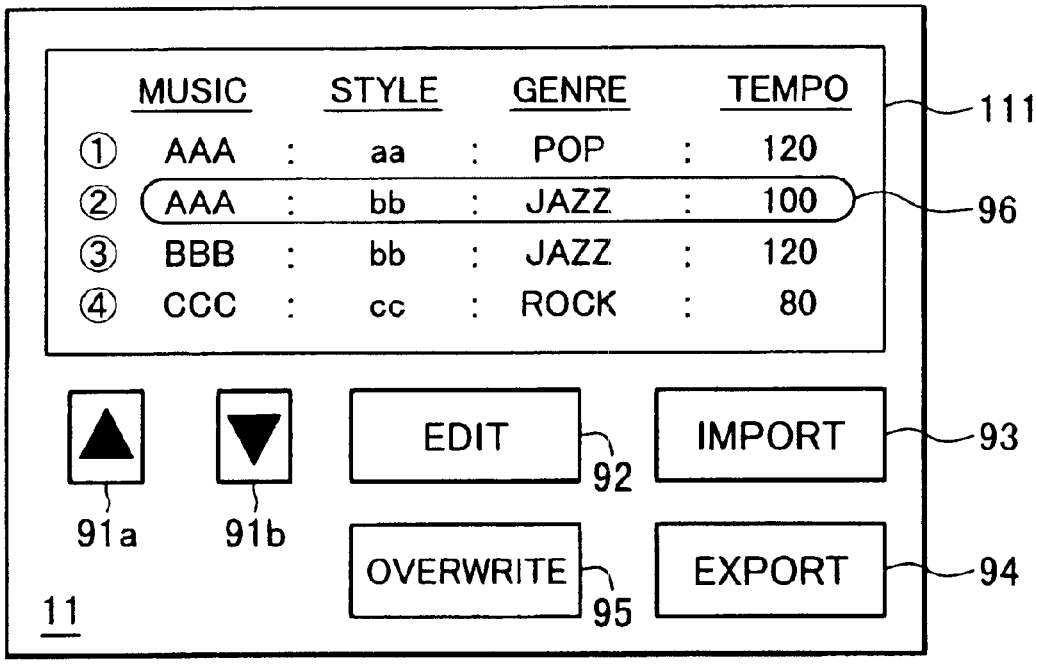
FIG. 4 shows an example of a main window.

FIG. 4 shows an example of a main window to be used when the style search function of the embodiment is performed. When the style search function to be later described with reference to FIG. 5 starts, the main window is displayed on the display device 11 of the electronic musical instrument 1 shown in FIG. 1.

This main window displays a list display area 111 and a software switch group including an up-cursor switch (SW) 91*a*, a down-cursor SW 91*b*, an edit SW 92, an import SW 93, an export SW 94, and an overwrite SW 95.

In the list display area 111, a list of all records stored in the record DB is displayed. The contents of one record are displayed in one row. The row surrounded by an ellipsoidal cursor 96 (hereinafter simply called a cursor) in the list display area 111 corresponds to the selected record. The cursor 96 moves up or down upon operation of the cursor SW 91*a* or 91*b* by a user, so that the record to be selected can be changed.

The cursor 96 may be of any type so long as a user can confirm the selected record. For example, the fonts or sizes of characters in the list may be changed or the colors of characters may be changed.

The edit SW 92, import SW 93, export SW 94 and overwrite SW 95 are used respectively for the edit process, import process, export process and overwrite process to be later described. By operating (depressing) each of these SW's, the corresponding process starts. The electronic musical instrument 1 is also provided with various switches (not shown) for controlling automatic performance, such as a reproduction switch for starting automatic performance and a stop switch for stopping the automatic performance.

Figure 5:
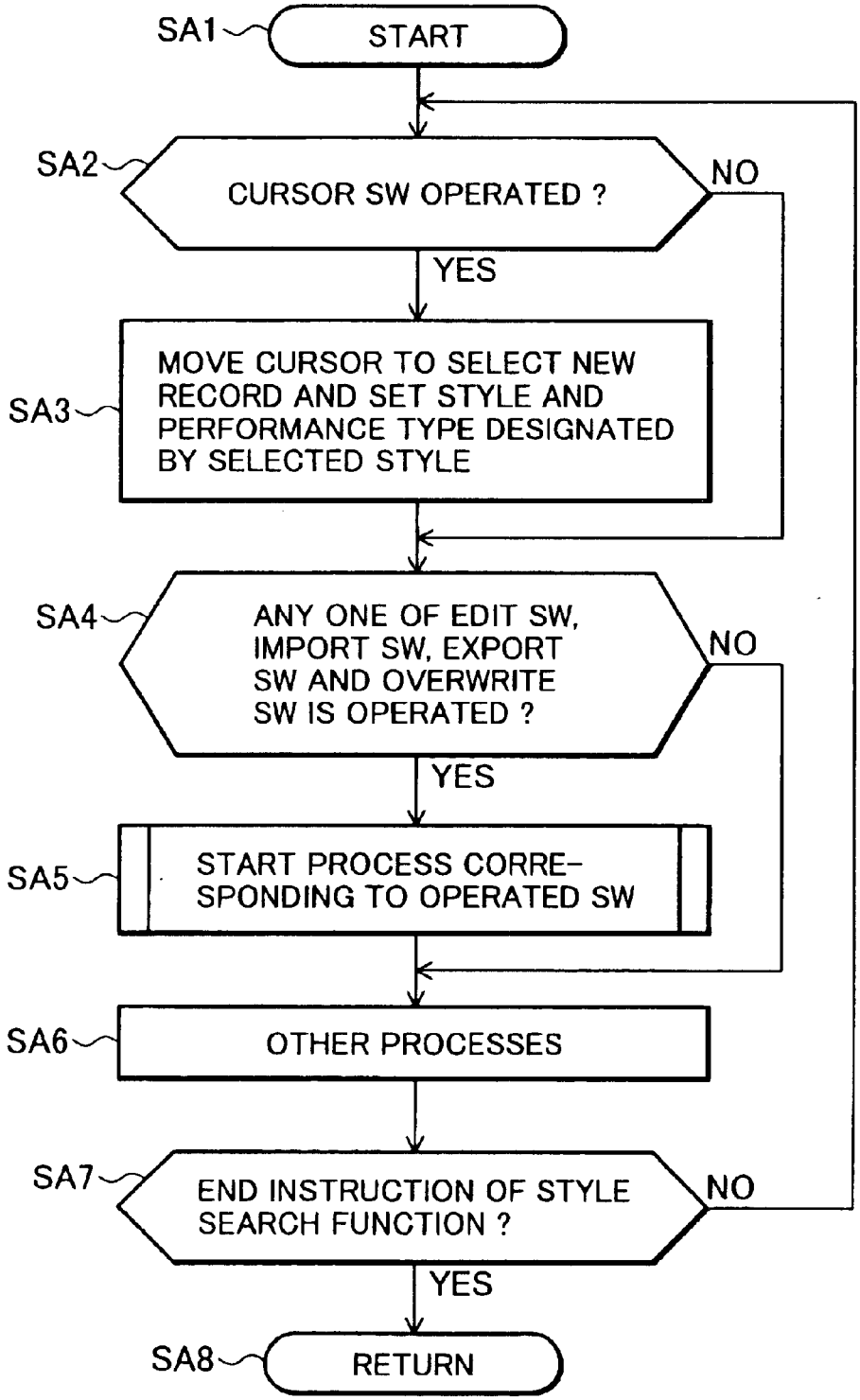
FIG. 5 is a flow chart illustrating a main process of a style search function to be executed by CPU 5 shown in FIG. 1, according to an embodiment of the invention.

FIG. 5 is a flow chart illustrating the main process of the style search function to be executed by CPU 5 shown in FIG. 1 according to the embodiment.

At Step SA1 the main process starts and the main window shown in FIG. 4 is displayed on the display device 11 to thereafter advance to the next Step SA2.

At Step SA2 an operation of the cursor SW by the user is detected. If the operation of the cursor SW is detected, the flow advances to the next Step SA3 indicated by a YES arrow. If the operation of the cursor SW is not detected, the flow skips to Step SA4 indicated by a NO arrow.

At Step SA3, in accordance with the operation of the cursor SW detected at Step SA2, the cursor 96 is moved to select a new record, and the style and performance type designated by the selected record are set. Thereafter, the flow advances to the next Step SA4.

In setting the style, by referring to the style number recorded in the selected record, the style corresponding to the style number is read from the style DB as the automatic accompaniment style and written in a read buffer of RAM 3.

The read buffer is reserved in RAM 3 and is used for temporarily storing an automatic accompaniment style. When the automatic accompaniment starts in response to depression of the style reproduction switch (not shown), the performance data in the style is sequentially read from the buffer in response to the clocks supplied from the timer 6 to thereby perform automatic accompaniment.

In setting the performance style, the tempo in the selected record is set as a reproduction tempo of automatic accompaniment.

At Step SA4 it is detected whether any one of the edit SW 92, import SW 93, export SW 94, and overwrite switch 95 shown in FIG. 4 is operated. If this operation is detected, the flow advances to Step SA5 indicated by a YES arrow, whereas any one of them is not operated, the flow skips to Step SA6 indicated by a NO arrow.

At Step SA5, the process corresponding to the switch operated at Step SA4 starts. Namely, if the edit SW 92 is operated, the edit process shown in FIG. 6 starts. If the import SW 93 is operated, the import process shown in FIG. 11 starts. If the export SW 94 is operated, the export process shown in FIG. 12 starts. If the overwrite SW 95 is operated, the overwrite process shown in FIG. 13 starts. During execution of each of these processes, the main process is suspended. After each process is terminated, the flow advances to the next Step SA6.

At Step SA6 another process starts. For example, the other process includes a process of sorting the order of records, a process of searching a record and the like. For example, the record sort process sorts the records in the ascending or descending order of music titles, or sort them in the order of genre, tempo or the like. The record search process searches a record in response to an input of characters or the like in the music title field. Thereafter, the flow advances to Step SS7.

At Step SA7 it is detected whether there is an end instruction of the style search function (main process). If the end instruction is detected, the flow advances to Step SA8 indicated by a YES arrow to terminate the main process. If the end instruction is not detected, the flow returns to Step SA2 indicated by a NO arrow.

Figure 6:
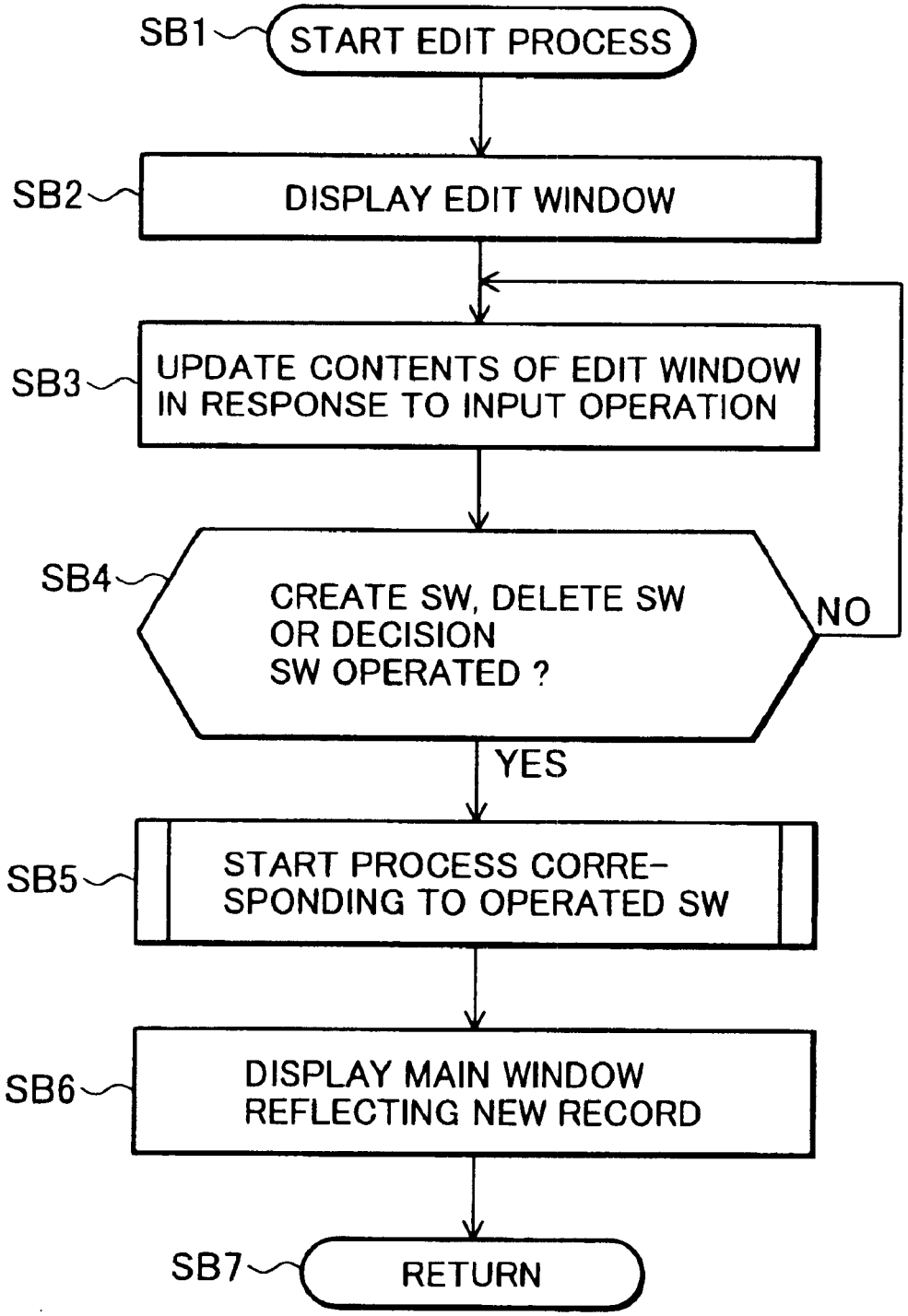
FIG. 6 is a flow chart illustrating an edit process at Step SA5 shown in FIG. 5.

FIG. 6 is a flow chart illustrating the edit process to be executed at Step SA5 shown in FIG. 5.

At Step SB1 the edit process starts to thereafter advance to the next Step SB2.

Figure 7:
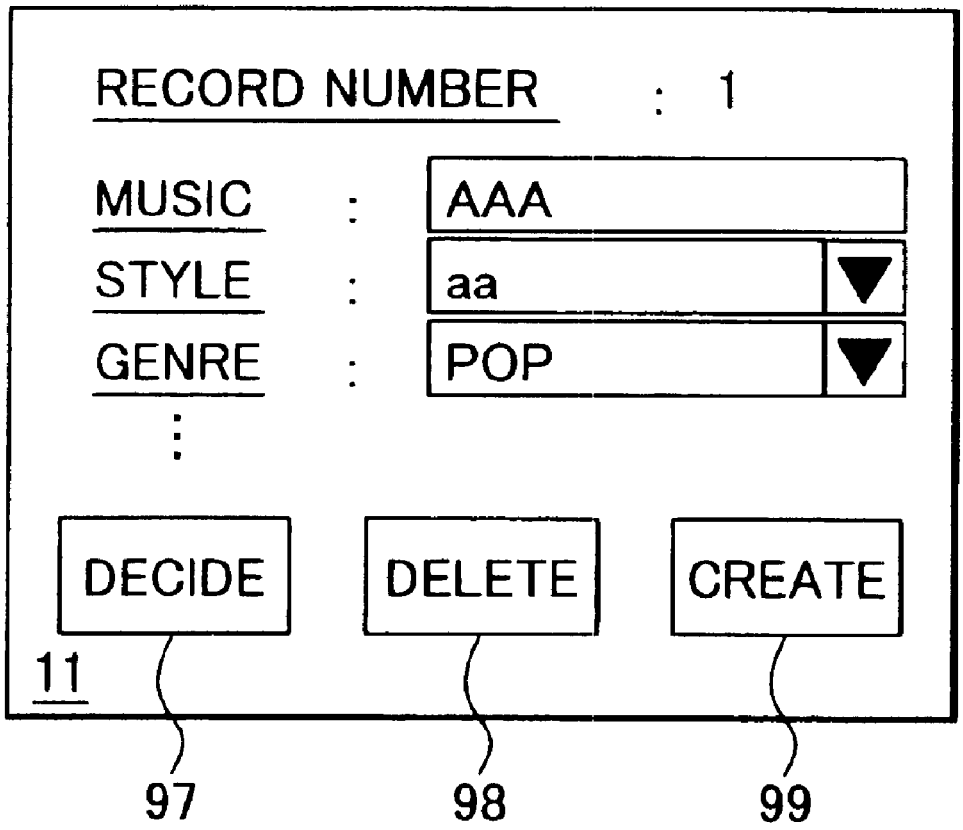
FIG. 7 shows an example of an edit window.

At Step SB2, an edit window shown in FIG. 7 is displayed on the display device 11. As shown in FIG. 7, this edit window displays the details of a record. Thereafter, the flow advances to the next Step SB3.

FIG. 7 shows an example of the edit window. This edit window shows the record number, music title, style and genre of the presently selected record (record selected by the cursor 96 before the edit SW 92 is operated), and in the lower area, a decision SW 97, a delete SW 98 and a create SW 99 which are software switches.

If a user desires to change the contents, new information is entered by using the operation unit 9. In this embodiment, the style, genre and the like are selected from a list of these items.

At Step SB3 in accordance with the input operation by the user, the edit window is updated to thereafter advance to the next Step SB4.

At Step SB4 it is detected whether one of the decide SW 97, delete SW 98 and create SW 99 shown in FIG. 7 is operated. If the operation is detected, the flow advances to Step SB5 indicated by a YES arrow, whereas if any one of the switches is not operated, the flow returns to Step SB3 indicated by a NO arrow.

At Step SB5 a process corresponding to the switch operated by the user at Step SB4 starts. Namely, if the decide SW 97 is operated, a decide process shown in FIG. 8 starts. If the delete SW 98 is operated, a delete process shown in FIG. 9 starts. If the create SW 99 is operated, a create process shown in FIG. 10 starts. During execution of each of these processes, the edit process is suspended. After each process is terminated, the flow advances to the next Step SB6.

At Step SB6, the main window reflecting the new record is displayed. Thereafter, at the next Step SB7 the edit process is terminated to return to the main process shown in FIG. 5.

Figure 8:
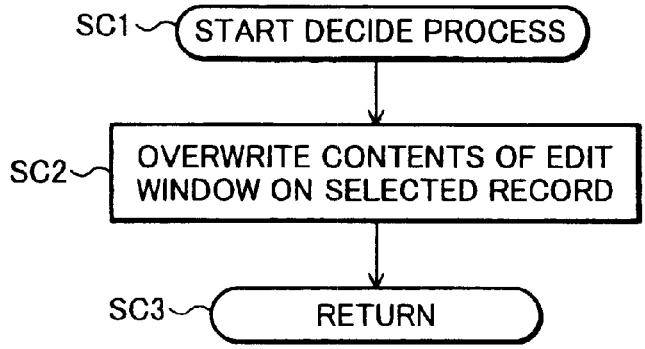
FIG. 8 is a flow chart illustrating a decide process at Step SB5 shown in FIG. 6.

FIG. 8 is a flow chart illustrating the decide process to be executed at Step SB5 shown in FIG. 6.

At Step SC1 the decide process starts to advance to the next Step SC2.

At Step SC2 the contents displayed in the edit window are overwritten in the selected record. Thereafter, the flow advances to the next Step SC3 whereat the decide process is terminated and the edit process shown in FIG. 6 resumes.

Figure 9:
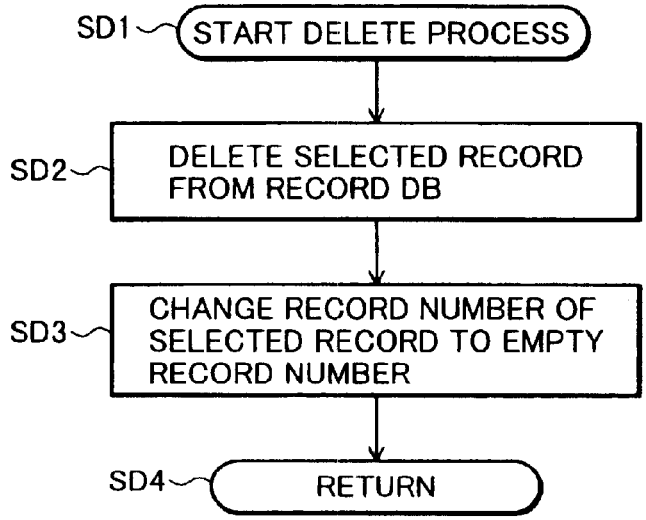
FIG. 9 is a flow chart illustrating a delete process at Step SB5 shown in FIG. 6.

FIG. 9 is a flow chart illustrating the delete process to be executed at Step SB5 shown in FIG. 6.

At Step SD1 the delete process starts to thereafter advance to the next Step SD2.

At Step SD2 the selected record is deleted from the record DB. Thereafter, the flow advances to the next Step SD3.

At Step SD3 the record number of the selected record is changed to an empty record number. Thereafter, at Step SD4 the delete process is terminated and the edit process shown in FIG. 6 resumes.

Figure 10:
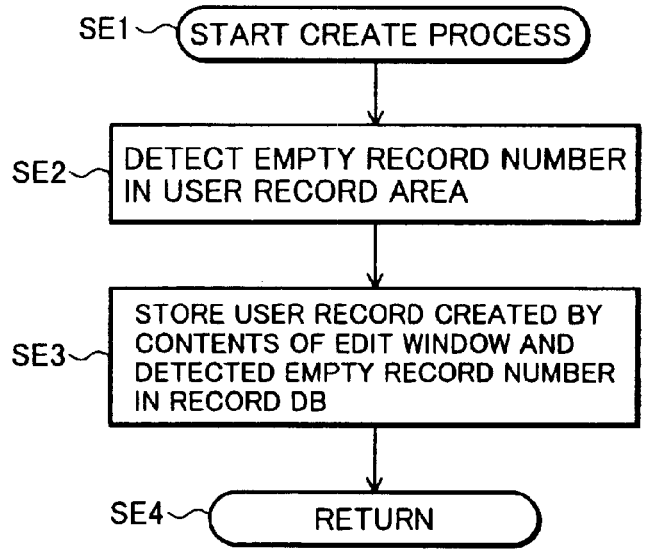
FIG. 10 is a flow chart illustrating a create process at Step SB5 shown in FIG. 6.

FIG. 10 is a flow chart illustrating the create process to be executed at Step SB5 shown in FIG. 6.

At Step SE1 the create process starts to thereafter advance to the next Step SE2.

At Step SE2 an empty record number in the user record area is detected. The record number not assigned to any record is an empty record number. If these empty record numbers are stored in a buffer or the like in the form of a list, the detection at Step SE2 can be performed quickly. The flow thereafter advances to the next Step SE3.

At Step SE3 a user record is created by adding the record number detected at Step SE2 to the contents of the edit window, and stored in the record DB. Thereafter, the flow advances to the next Step SE4 whereat the create process is terminated to resume the edit process shown in FIG. 6.

Figure 11:
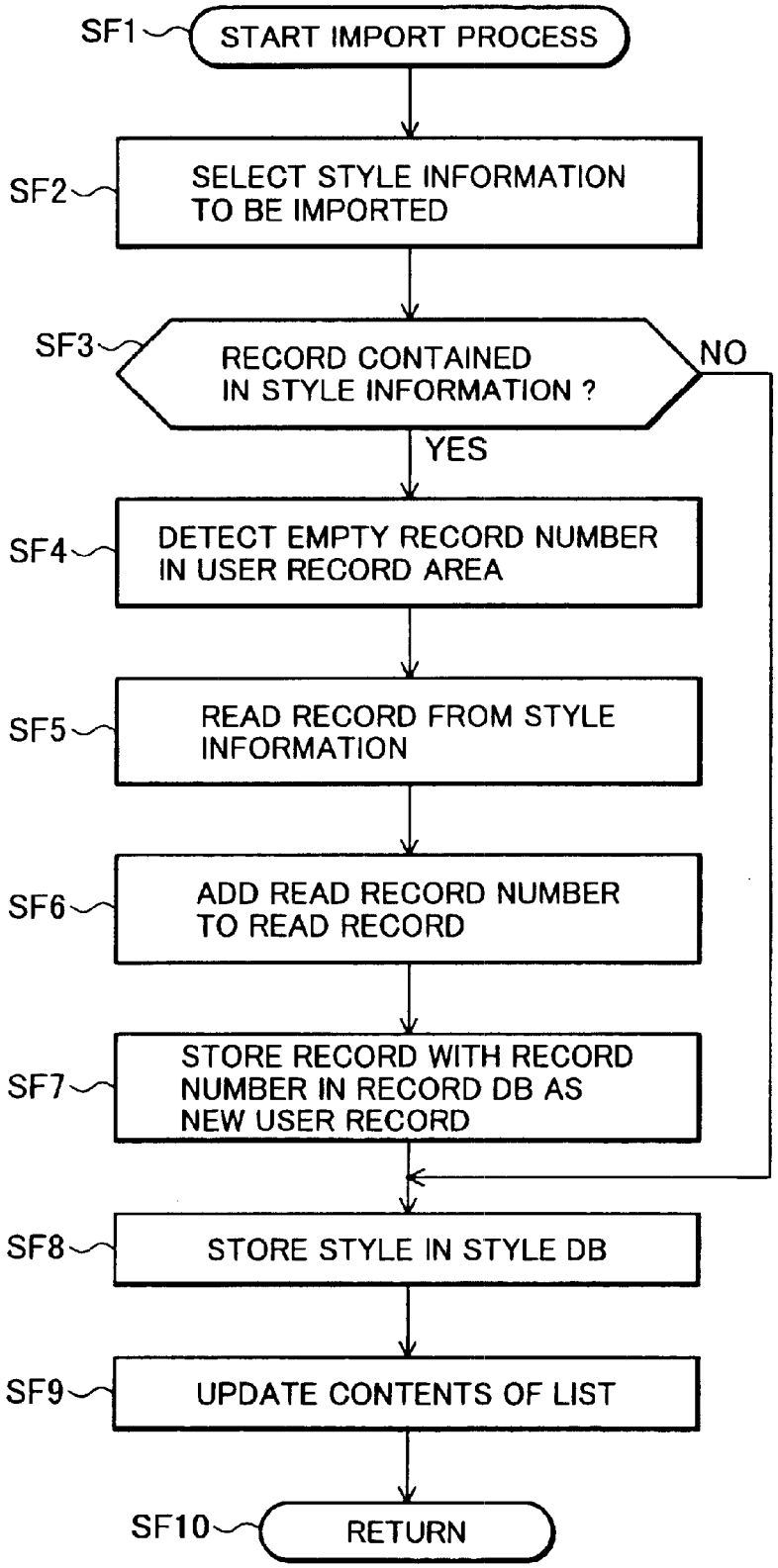
FIG. 11 is a flow chart illustrating an import process at Step SA5 shown in FIG. 5.

FIG. 11 is a flow chart illustrating the import process to be executed at Step SA5 shown in FIG. 5. In the import process, new style information (a combination of a style and records) is read from a storage medium in the external storage unit 7 shown in FIG. 1, or received from the communication network 18 via the communication I/F 17, and added to the style DB and record DB. In the following, it is assumed that new style information is read from a floppy disc.

At Step SF1 the import process starts to thereafter advance to the next Step SF2.

At Step SF2 the style information to be imported is selected. In this case, all style information stored in the floppy disc (storage medium) is preferably displayed on the display device 11 in the form of a list. A user selects the style information to be imported, from the list. After the user selects the style information, the flow advances to the next Step SF3.

At Step SF3 it is checked whether any record is contained in the selected style information. If contained, the flow advances to Step SF4 indicated by a YES arrow, whereas if not contained, the flow skips to Step SF8 indicated by a NO arrow.

At Step SF4 an empty record number in the user record area is detected. If the empty record number is detected, the flow advances to the next Step SF5.

At Step SF5 a record is read from the style information. Thereafter, the flow advances to the next Step SF6.

At Step SF6 the detected record number is assigned to the read record. Thereafter, the flow advances to the next Step SF7.

At Step SF7 the record assigned the record number is stored in the user record area of the record DB. Thereafter, the flow advances to the next Step SF8. If the style information contains a plurality of records, the processes at Steps SF4 to SF7 are repeated for each record.

At Step SF8 the style is read and stored in the style DB. Thereafter, the flow advances to the next Step SF9.

At Step SF9 the list in the list display area 111 of the main window shown in FIG. 4 is updated in accordance with the imported style and record. Thereafter, the flow advances to the next Step SF10 whereat the import process is terminated to resume the main process shown in FIG. 5.

Figure 12:
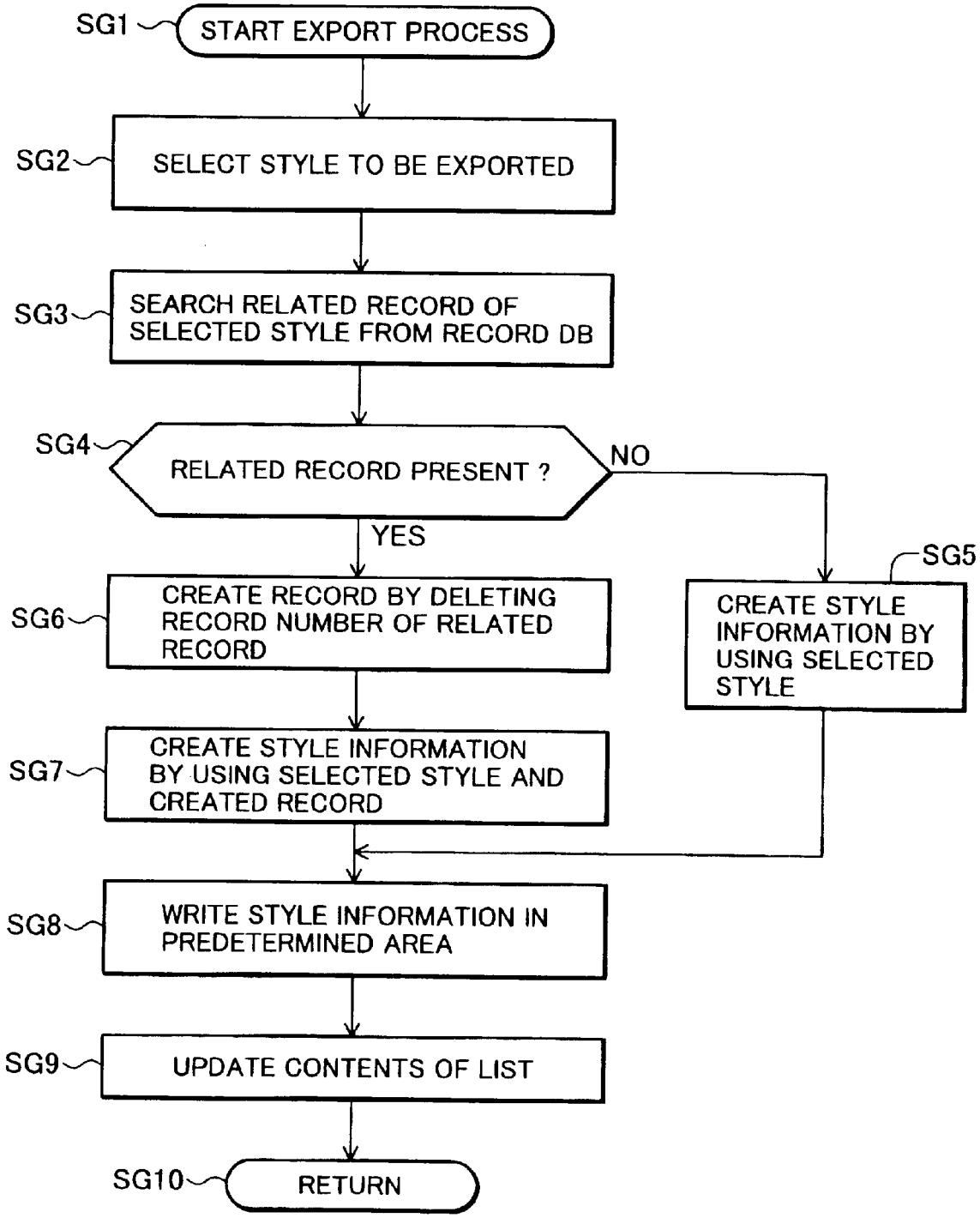
FIG. 12 is a flow chart illustrating an export process at Step SA5 shown in FIG. 5.

FIG. 12 is a flow chart illustrating the export process to be executed at Step SA5 shown in FIG. 5. In the export process, the style desired by a user and a related record are read from the style DB and record DB and supplied to the external by recording them in a storage medium in the external storage unit 7 shown in FIG. 1 or by transmitting them to the communication network 18 via the communication I/F 17. It is assumed that the style and related record are stored in a floppy disc.

At Step SG1 the export process starts to thereafter advance to the next Step SG2.

At Step SG2 the style to be exported is selected. In this case, the style is selected indirectly by selecting a record displayed in the main window shown in FIG. 4 to search a style related to the selected record. After the user selects the style, the flow advances to the next Step SG3.

A list of all styles stored in the style DB may be displayed on the display device 11. In this case, a user selects a style to be exported.

At Step SG3 a record related to the selected style (record having the style number of the selected style) is searched from the record DB. Thereafter, the flow advances to the next Step SG4.

At Step SG4 it is judged whether the related record was detected at Step SG3. If the related record was detected, the flow advances to Step SG6 indicated by a YES arrow, whereas if not detected, the flow branches to Step SG5 indicated by a NO arrow whereat the selected style is read from the style DB and the style information is created to thereafter advance to Step SG8.

At Step SG6 a record is formed by deleting the record number from the detected related record. Thereafter, the flow advances to the next Step SG7.

At Step SG7 the style information is created by using the selected style and created record. Thereafter, the flow advances to the next Step SG8.

At Step SG8 the style information is written in a predetermined area of a floppy disc. If the style information is to be transmitted to the communication network 18, it is transmitted to a computer or the like having a designated address. Thereafter, the flow advances to the next Step SG9.

At Step SG9 the list in the list display area 111 in the main window shown in FIG. 4 is updated in accordance with the exported style and record. Thereafter, the flow advances to the next Step SG10 whereat the export process is terminated and the main process shown in FIG. 5 resumes.

In this embodiment, in the export process, the exported style and record are not deleted from the databases. Instead, the exported style and record may be deleted.

Figure 13:
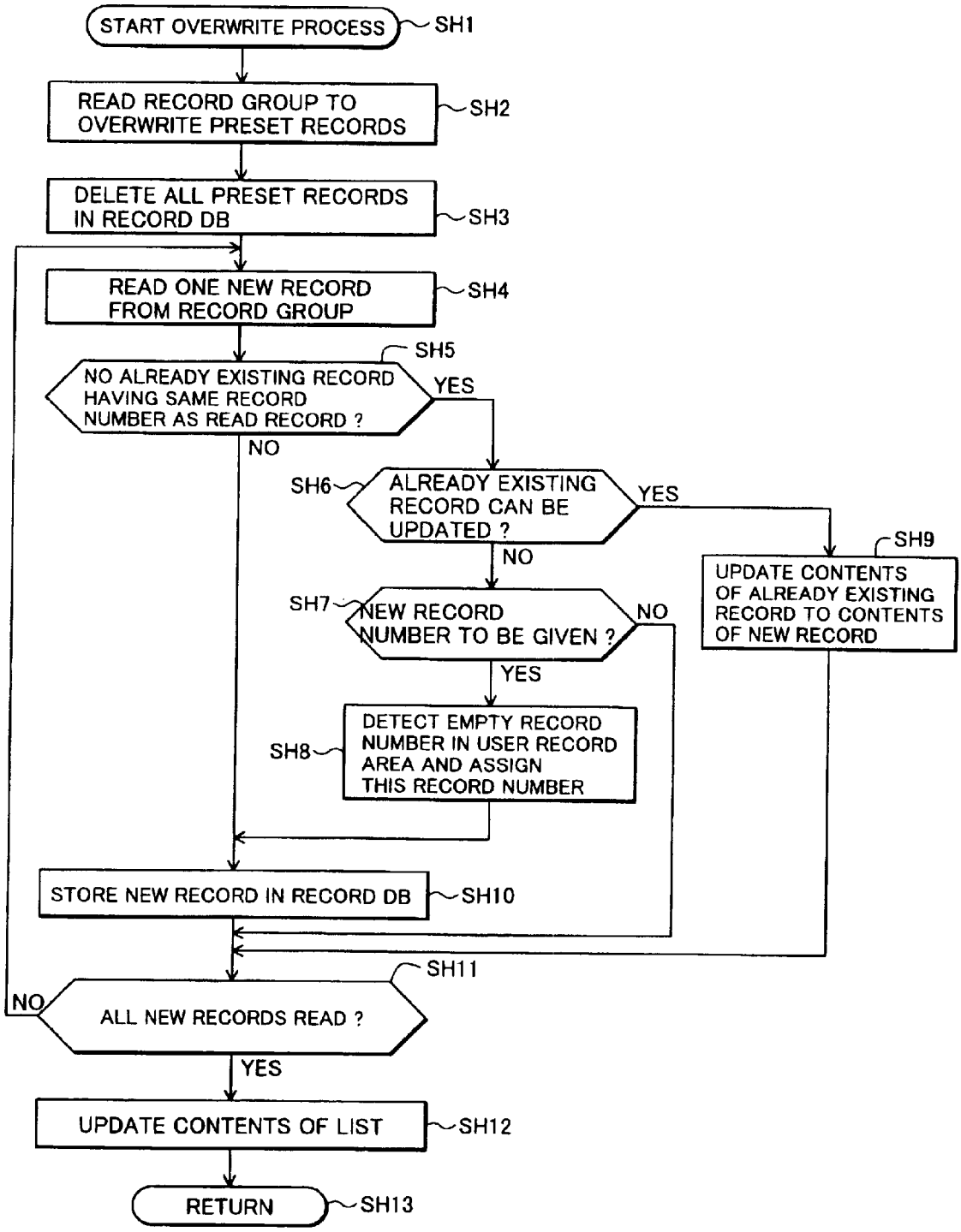
FIG. 13 is a flow chart illustrating an overwrite process at Step SA5 shown in FIG. 5.

FIG. 13 is a flow chart illustrating the overwrite process to be executed at Step SA5 shown in FIG. 5. In the overwrite process, a new record group is read from a storage medium in the external storage unit 7 shown in FIG. 1 or received from the communication network 18 via the communication I/F 17 to change the version or update the record DB. The new record group has a plurality of preset records. It is assumed that the new record group is read from a floppy disk.

At Step SH1 the overwrite process starts to thereafter advance to the next Step SH2.

At Step SH2 a new record group to be overwritten in the record DB is read from a storage medium such as a floppy disc into the read buffer of RAM 3. Thereafter, the flow advances to the next Step SH3.

At Step SH3, all preset records in the preset record area of the record DB are deleted. Records in the record DB are therefore only the user records. Thereafter, the flow advances to the next Step SH4.

At Step SH4 one new record is read from the read buffer which stores the new record group. Thereafter, the flow advances to the next Step SH5.

At Step SH5 it is confirmed whether there is no already existing record having the same record number as the read new record. New preset records can have an increased number of records, and hence can extend beyond the previous preset record numbers. That is, a new preset record can have a record number which is assigned to the user record. If there is no already existing record having the same record number, the flow advances to Step SH10 indicated by a NO arrow. If there is an already existing record having the same record number, the flow branches to Step SH6 indicated by a YES arrow.

At Step SH6 it is confirmed whether the already existing record having the same record number as the new record and detected at Step SH5 is permitted to be updated to the new record. If the user rejects update, the flow advances to Step SH7 indicated by a NO arrow, whereas if the user accepts update, the flow branches to Step SH9 indicated by a YES arrow.

At Step SH7 it is confirmed whether a new record number is given to the already existing record having the same record number. If both the already existing record and the new record are required, it is necessary to assign a new record number. If a new record number is to be assigned, i.e., if the new record is required, the flow advances to Step SH8 indicated by a YES arrow. If the new record number is not assigned, i.e., if the new record is not required, the already existing record having the same record number is not stored in the record DB to thereafter advance to Step SH11 indicated by a NO arrow.

At Step SH8 the record number of the new record is deleted and an empty record number in the user record area is detected. The detected record number is assigned to the new record to thereafter advance to Step SH10.

At Step SH9 the contents of the already existing record are updated to the contents of the new record (overwrite). Thereafter, the flow advances to Step SH11.

At Step SH10 the new record is stored in the record DB to thereafter advance to the next Step SH11.

At Step SH11 it is checked whether all new records are read from the read buffer which stores the new record group. If all new records are read, the flow advances to Step SH12 indicated by a YES arrow, whereas if there is a new record still not read, the flow returns to Step SH4.

At Step SH12 the contents of the main window of the display device 11 are updated to reflect the new records updated at Step SH9 or stored at Step SH10. Thereafter, the flow advances to the next Step SH13 whereat the overwrite process is terminated to return to the main process shown in FIG. 5.

According to the embodiment, a user can freely edit the contents of the record DB so that a style search system desired by the user can be formed.

Since a user can import or export the contents of the record DB, a style search system desired by the user can be formed easily.

Since the contents of the record DB can be overwritten and updated, version-up is easy. In this version-up, only the preset records are overwritten and the already existing user records are left. It is therefore possible to configure a record DB properly reflecting the intentions of both a preset record provider (developer of data and system) and a user.

Since a user can change easily the contents of the record DB, it is possible to make the records in the record DB easy to be used by the user. Searching a style can be performed quickly and easily.

In this embodiment, although preset records and user records are distinguished by record numbers, any other distinguishing method may be used.

For example, identifiers for distinguishing between the preset and user records may be added to records, or preset and user records may be stored in different databases.

The embodiment may be realized by a computer or the like installed with a computer program and the like realizing the embodiment functions.

In this case, the computer program and the like realizing the embodiment functions may be stored in a computer readable storage medium such as a CD-ROM and a floppy disc to distribute it to a user.

If the computer and the like are connected to the communication network such as a LAN, the Internet and a telephone line, the computer program, data and the like may be supplied via the communication network.

The present invention has been described in connection with the preferred embodiments. The invention is not limited only to the above embodiments. It is apparent that various modifications, improvements, combinations, and the like can be made by those skilled in the art.

What is claimed is:

1. A musical performance data search system for an automatic musical accompaniment apparatus, comprising:

a first storage unit for storing a plurality of first records, which include performance data for automatic accompaniment of the automatic musical accompaniment apparatus;

a second storage unit for storing a second record relating to one of the first records, the second record including information for searching the first record relating to the second record;

a designating unit for designating the second record;

an editing unit for editing and updating the second record designated by said designating unit, wherein the second record is overwritten with edited content;

a reading unit for reading the first record relating to the second record designated by said designating unit; and a display for displaying the first records, the second record, and the edited second record.

2. The musical performance data search system according to claim 1, further comprising a data input unit for inputting data externally, wherein when said data input unit inputs the first record and the second record relating to the first record.

3. The musical performance data search system according to claim 1, further comprising a data output unit for outputting data externally, wherein when said data output unit outputs the first record and the second record relating to the first record.

4. The musical performance data search system according to claim 1, further comprising an overwriting unit for reading and overwriting the second record externally, wherein the second record includes preset data stored in advance and user data created by a user, and said overwriting unit is adapted to overwrite the preset data.

5. A storage medium storing a program executable by a computer for executing a musical performance data search for an automatic musical accompaniment apparatus, the program comprising instructions for;

designating a second record relating to one of a plurality of first records, which include performance data for automatic accompaniment of the automatic musical accompaniment apparatus, the second record relating to one of the first records, and including information for searching the first record relating to the second record;

editing and updating the second record, wherein the second record is overwritten with edited content; and reading the first data record relating to the second record; and displaying the first records, the second record, and the edited second record.

* * * * *